US006892556B2

(12) United States Patent
Landenberger

(10) Patent No.: US 6,892,556 B2
(45) Date of Patent: May 17, 2005

(54) KNITTING MACHINE NEEDLE

(75) Inventor: Ingo Landenberger, Messtetten (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/895,342

(22) Filed: Jul. 21, 2004

(65) Prior Publication Data

US 2005/0016222 A1 Jan. 27, 2005

(30) Foreign Application Priority Data

Jul. 22, 2003 (DE) ..... 103 33 172

(51) Int. Cl.[7] ..... D04B 35/02
(52) U.S. Cl. ..... 66/123
(58) Field of Search ..... 66/116, 119, 120, 66/123; 163/2

(56) References Cited

U.S. PATENT DOCUMENTS 3,748,875 A * 7/1973 Slof et al. ..... 66/123
4,036,036 A * 7/1977 Ashmead et al. ..... 66/123
4,553,411 A * 11/1985 Schuler et al. ..... 66/123
4,625,527 A * 12/1986 Fukuhara ..... 66/123
4,681,150 A 7/1987 Fukuhara
4,783,976 A * 11/1988 Sos ..... 66/123
5,029,456 A * 7/1991 Sos et al. ..... 66/123
5,901,582 A * 5/1999 Hennig et al. ..... 66/123
6,122,938 A 9/2000 Henning et al.

FOREIGN PATENT DOCUMENTS

DE OS 24 08 567 9/1975
DE 36 12316 A1 10/1986
DE 197 40 985 C2 9/1999

* cited by examiner

*Primary Examiner*—Danny Worrell
(74) *Attorney, Agent, or Firm*—Fitch, Even, Tabin & Flannery; Norman N. Kunitz; George H. Spencer

(57) ABSTRACT

A knitting machine needle (1), having a butt (3) pointing away from its needle body (2) and a shank (15) extending from the needle body as far as a hook (16), has a deflection (18) which is disposed between the hook (16) and the butt (3). The deflection (18) is provided with at least one recess (24), which locally alters the wave resistance of the deflection (18) and leads to a reduction in hook breakage when the butt (3) is exposed to impacts.

20 Claims, 4 Drawing Sheets

KNITTING MACHINE NEEDLE

CROSS REFERENCE TO RELATED APPLICATIONS

This application claims the priority of German Patent Application No. 103 33 172.7, filed on Jul. 22, 2003, the subject matter of which, in its entirety, is incorporated herein by reference.

FIELD OF THE INVENTION

The invention relates to a knitting machine needle and to a needle set which contains at least one such knitting machine needle.

BACKGROUND OF THE INVENTION

The service life of knitting machine needles depends, among other factors, on the operating speed of the knitting machine. The faster the machine runs, the more strongly the individual needles are accelerated and braked in the longitudinal direction. With increasing operating speed, hook breakage increases. In the past, manifold attempts have already been made to improve this situation. From U.S. Pat. No. 4,036,036, it is known, in the needle body of a knitting machine needle, to embody one or more straight, curved, angled, offset-bent, splitting, undulating or otherwise embodied slots or openings that transversely penetrate the needle body. These slots are intended to reduce stresses, absorb impacts, and damp vibration. For that purpose, the slots are disposed solely in a region of the needle body whose height, measured from the needle back to the top, is greater than that of the hook. This region is adjoined by a shank, which extends as far as the hook and is embodied as continuously solid.

From German Patent Disclosure DE-OS 24 08 567, a knitting machine needle is known whose needle body between the hook and the butt is embodied as a meandering stem. It has an improved service life.

From German Patent Disclosure DE 28 20 925 A1, a needle is furthermore known whose needle body between the butt and the hook is formed by a doubly deflected stem. Some parts of the stem vary in height.

From German Patent Disclosure DE 30 14 751 A1, a knitting machine needle is furthermore known whose needle body has generously sized punched openings, so that only adjoining the needle back and adjoining the top of the needle does a narrow stem remain in each case. These needles, as well, have proven themselves to a certain extent. All needles have their limits, however, which become apparent especially at maximum operating speeds. Hook breakage then occurs. In needle sets which contain knitting machine needles with different butt positions, the hook breakage increases, especially in needles whose butt is especially close to the hook.

With this as the point of departure, it is the object of the invention to create knitting machine needles and needle sets or needle families, which contain such a knitting machine needle, that have an improved service life.

SUMMARY OF THE INVENTION

The above object is generally achieved according to the present invention by a knitting machine needle of that has a needle body with a stemlike portion, extending between the butt and the hook, that is provided with a deflection, also called a meandering curve. At least one recess is embodied in the region of this deflection. This recess lends the deflection particular resilience and a pronounced stamping action. It has been demonstrated that with this provision, the requisite stability of the needle shank can be preserved, and on the other hand the tendency to hook breakage is drastically reduced, even if major impactlike loads are put on the needle. As a result, the service life of the knitting machine needles in question can be increased substantially. This is especially true for needle families or needle sets in which individual needles have only slight spacings between the butt and the hook. Especially in such needles, in which there is only a single meandering curve or in other words a single deflection between the butt and the needle, the recess proves to be especially favorable in terms of both the service life and the impact-bearing capacity.

The deflection can be formed by an undulating shank portion or by individual portions (first, second and third portions) that are each straight and adjoin one another and form an obtuse or right angle with one another. Preferably the applicable portions have the same heights as each other; the height of the first and third portion is measured perpendicular to the back side of the needle, while the height of the second portion is preferably measured approximately parallel to it. The needle body height is preferably from 3 to 5 times the height of the individual portions. These ratios have proved advantageous.

In a preferred embodiment, the recess is embodied as a slot and extends in interrupted or uninterrupted fashion over the entire deflection. The recess can be longer than the Z-shaped deflected region; that is, it can protrude past the deflected region to one side or both sides, and in particular it can extend into or to beneath the region of the butt. The recess can also be provided in the form of a series of circular recesses or recesses of other shapes. The slot may either be embodied as a complete, unfilled punched opening, or it may be filled with a damping (energy-dissipating) material. Alternatively, the slot may be embodied not as a complete punched opening, but only as a countersunk feature or groove on one or both sides. Such embodiments lead to somewhat greater rigidity of the shank than embodiments with a complete punched opening. Filling up the punched openings or slot indentations (recesses on one or both sides and having a bottom) with damping material also the advantage that the slot does not fill up with extraneous substances such as oil and dirt, which can affect the vibration properties of the shank. The properties of the knitting machine needle then remain unchanged over its operating time, at least to the extent that these properties are determined by the properties of the shank.

In a further embodiment, the needle of the invention can have a plurality of deflections or meanders and a plurality of butts. In this respect it has proved advantageous that as a function of the parameters in the knitting machine and of the knitting conditions, individual deflections are provided with recesses of the invention, independently of their position relative to the butt. In other cases, all the deflections may be provided with recesses according to the invention. As a result, various needles in one needle family are provided with recesses of the invention at various points.

Further details of embodiments of the invention will become apparent from the drawing, description or claims.

BRIEF DESCRIPTION OF THE DRAWINGS

In drawing, exemplary embodiments of the invention are shown. Shown are:

FIGS. 6 through 9, each in cross section, embodiments of knitting machine needles of the invention.

DETAILED DESCRIPTION OF THE INVENTION

Figure 1:
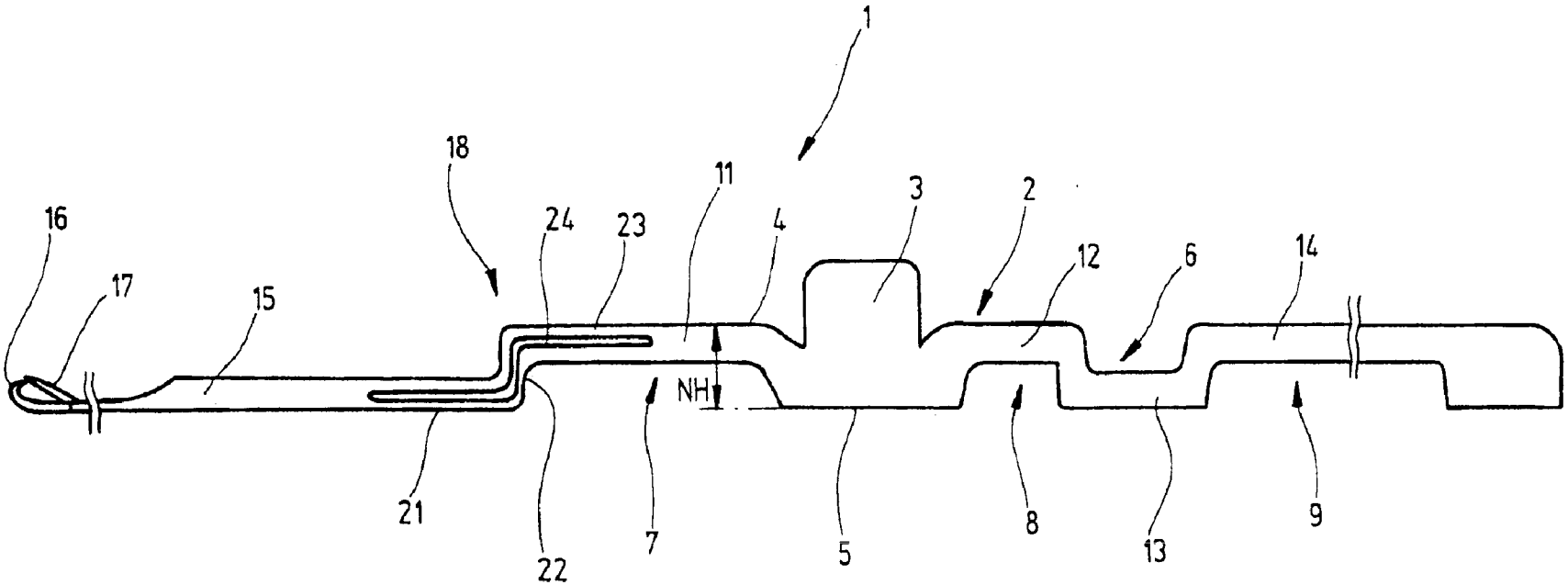
FIG. 1, a side view of one embodiment of a knitting machine needle of the invention.

In FIG. 1, a knitting machine needle 1 is shown of the kind that can be used in particular for high-speed knitting machines. It has a flat needle body 2, which is adjoined by a butt 3 of the same thickness that protrudes at a right angle away from a narrow, striplike face 4 that defines the top side of the needle. Parallel to this face, a narrow, striplike needle back 5 is embodied on the opposite side of the needle body 2. Both the face 4 and the needle back 5 are interrupted by recesses 6, 7, 8, 9, specifically in such a way that to a certain extent the needle body 2 is formed by stems 11, 12, 13, 14 adjoining one another in meandering fashion. The height NH of the needle body extends from the face 4 to the needle back 5.

Figure 3:
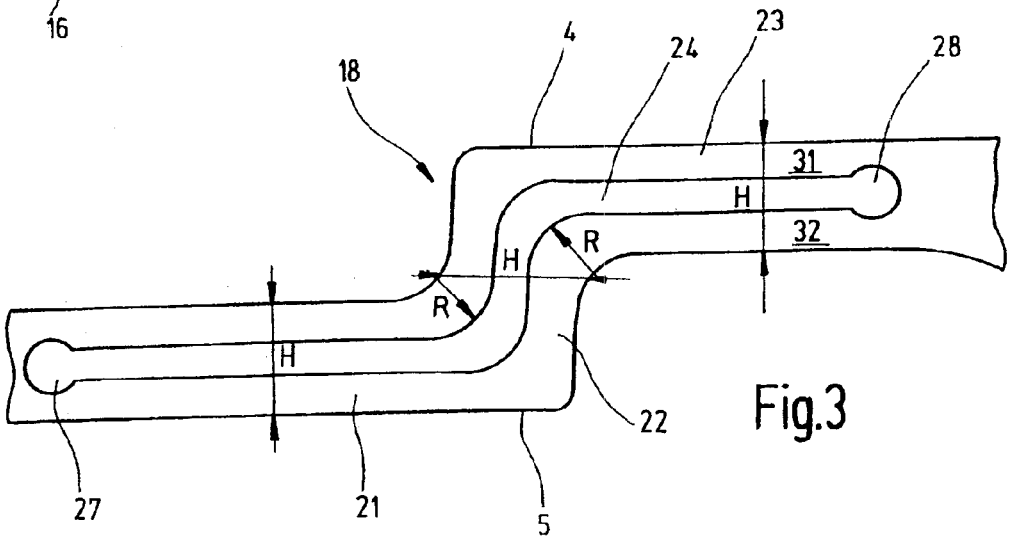
FIG. 3, a fragmentary view on a different scale of the knitting machine needle of FIG. 1.

The needle body 2 is adjoined by a shank 15, which carries a hook 16 on its end. The shank 15 is elongated and straight and tapers on one end toward the hook 16. In the vicinity of the hook, a pivotably supported latch 17 may be provided. Between the needle body 2 and the shank 15, a deflection 18 (meander) is embodied, which connects the stem 11 with the shank 15 that is offset parallel to it. The deflection includes a first portion 21, a second portion 22, and a third portion 23; the portion 21 is part of the shank 15, and the portion 23 is part of the stem 11. The portions 21, 22, 23 each form approximately a right angle with one another, and as FIG. 3 shows, they all have approximately the same height H. The height H for the first portion 21 and for the third portion 23 should be measured perpendicular to the needle back 5, and for the second portion 22 it should be measured approximately parallel to the needle back 5. The length of the portion 22 to be measured between the face 4 and the needle back 5 preferably amounts to from 3 to 5 times the height H of the needle shank 15.

A recess 24 extends along the deflection 18, preferably centrally through the respective portion 21, 22, 23. The recess 24 may be embodied as a slot which penetrates the needle body completely. This is shown as an example in FIG. 6, which shows a vertical section through the portion 23. The recess 24 opens out here on both flat sides 25, 26 of the needle body 2. The section through the portions 21 and 22 has a similar appearance.

The slot forming the recess 24 can, as FIG. 3 shows, be embodied in an S shape. The ends of the slot preferably adjoin circular openings 27, 28, which are intended to prevent a concentration of stress on the end of the slot. In the vicinity of the transitions between the portions 21, 22 and between the portions 22 and 23, the slot can be embodied in a rounded S shape. The radii R of the rounding are preferably greater than the width of the slot that is defined by parallel flanks. The width of the slot is furthermore preferably less than the width of the stem portions, or webs, 31, 32 that are present above and below the slot. The slot width can be reduced to such an extent that the slot becomes a seam at which the stems 31, 32 are in contact with one another. However, it is preferred that some free space be left between the stems, as FIG. 3 shows.

An embodiment is also possible in which the circular openings 27, 28 each have a radius whose size is equal to half the width of the recess 24.

The knitting machine needle 1 described thus far functions as follows:

In operation, it is inserted into the needle track of a needle bed. The butt 3 engages a cam. Via the butt 3, the knitting machine needle 1 is axially accelerated and braked in rapid succession. Impactlike actions on the butt 3 can occur in the process and cause an excitation of waves or oscillations that propagate in the needle body 2. Because of the recess 24, the deflection 18 gains resilience and damping for such waves, which are thus effectively kept away from the shank 15 and in particular from the hook 16. Even at a heavy load on the needle, that is, at a high operating speed and with impactlike needle accelerations and braking events, hook breakage is hardly to be expected.

Figure 2:
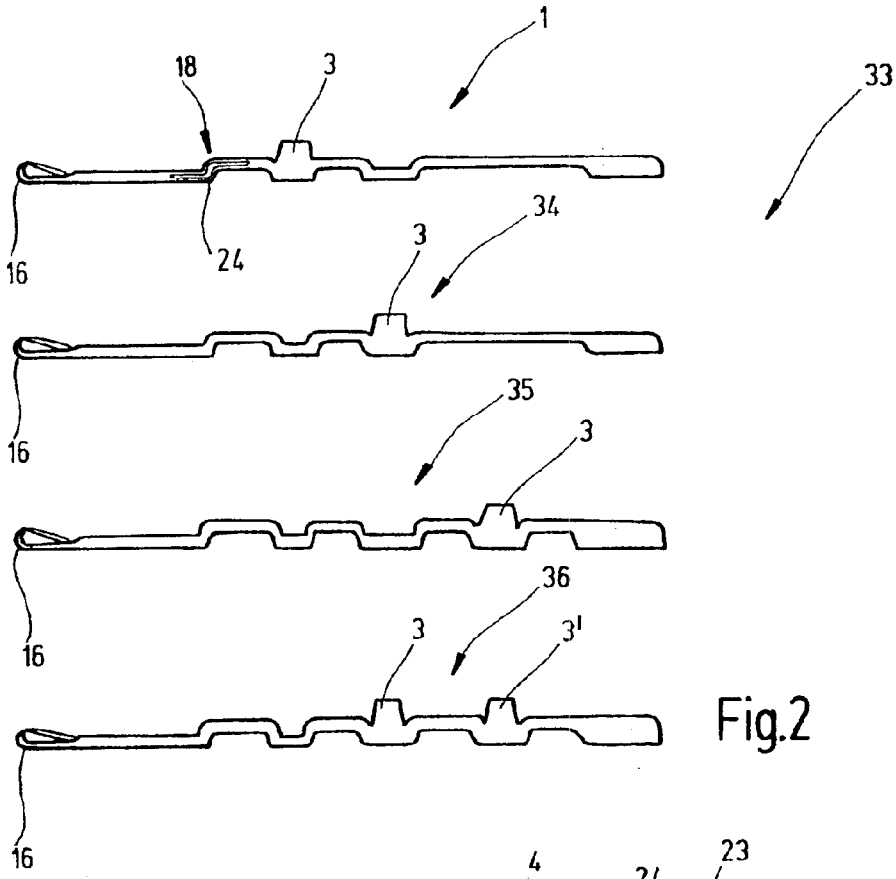
FIG. 2, one example of a needle family of the invention, with side views of the individual knitting machine needles.

FIG. 2 illustrates a needle family 33, to which various knitting machine needles 1, 34, 35, 36 belong. While the knitting machine needle 1 matches the knitting machine needle described above, the knitting machine needles 34, 35, 36 do not have a slotted deflection. Instead, their needle bodies are merely provided with closed deflections, so that overall they are embodied in meandering form. The knitting machine needles 34, 35, 36 differ from the knitting machine needle 1 in the number of deflections between each butt 3 and the associated hook 16. Thus in the needle family 33, at least the knitting machine needle 1 in which only one deflection 18 is provided between the butt 3 and the hook 16 has a corresponding recess 24 extending over the deflection 18. The other knitting machine needles 34, 35, 36 may be provided with recesses, but need not be so provided.

A needle set formed of such a needle family 33 has high load-bearing capacity and a long service life overall. In particular, the service life of the knitting machine needle 1, in which the butt 3 is closest to the hook 16 in comparison to the other knitting machine needles 34, 35, 36, is not at all shorter than the service life of the other knitting machine needles 34, 35, 36.

Figure 4:
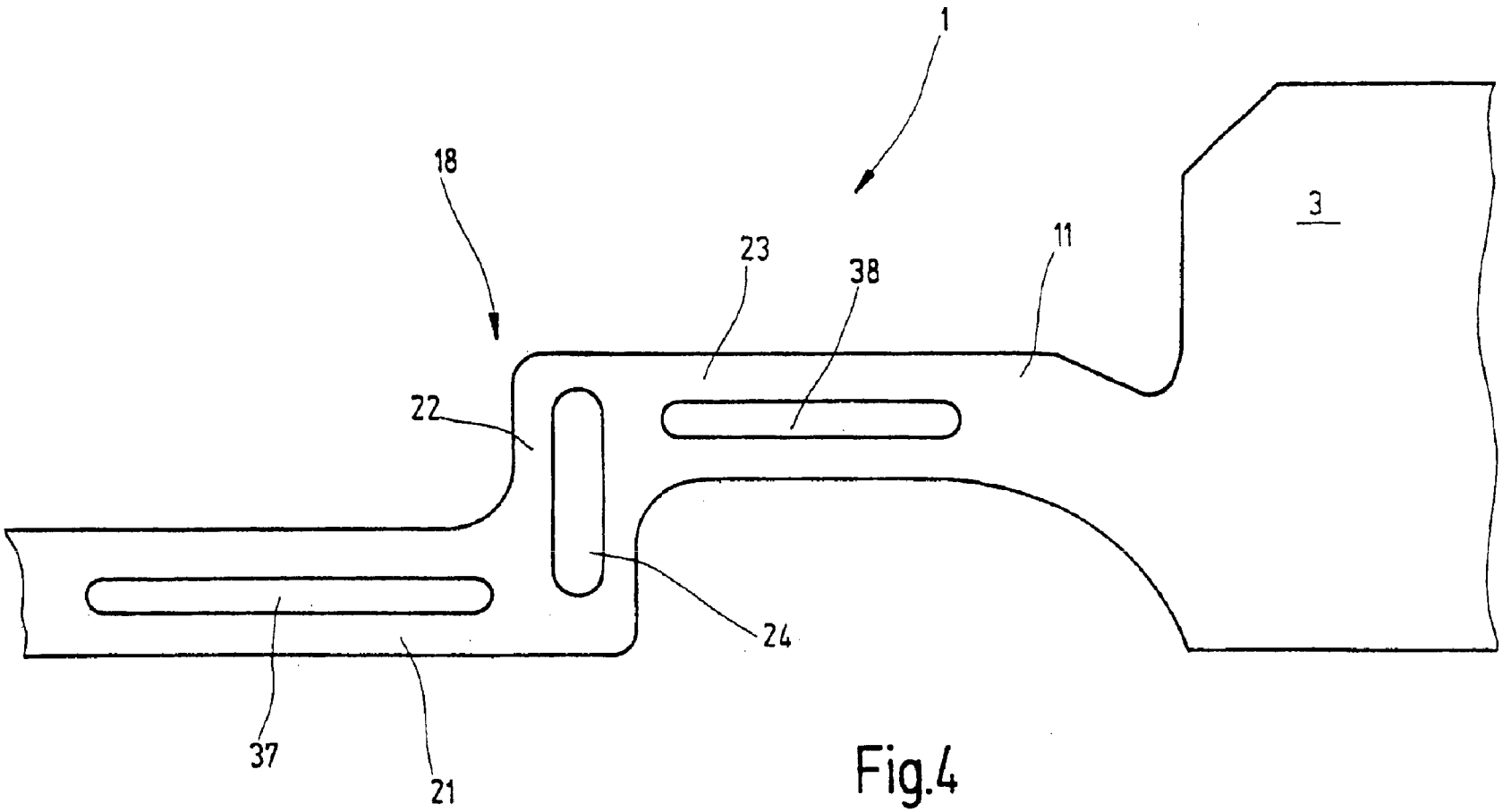
FIGS. 4 and 5, fragmentary side views of modified embodiments of knitting machine needles of the invention.

FIG. 4 illustrates a modified embodiment of the knitting machine needle 1. The butt 3 is adjoined by the stem 11 with the deflection 18, in which in addition to the recess 24, further recesses 37, 38 are provided. All the recesses 24, 37, 38 are embodied as respective slots and are disposed longitudinally in the respective portion 21, 22, 23. Between each of the straight slots 37, 24, 38, a spacing is present that is approximately the same size as the width of one slot. The recesses 37, 24, 38 may also be embodied as covering more than one portion. For instance, the recess 38 may protrude from portion 23 into portion 22, and the recess 37 may protrude from portion 21 into portion 22. The recess 24 can protrude from portion 21 across portion 22 and on into the portion 23. In each of these described arrangements, the corresponding recesses are disposed accordingly with spacing from one another.

Figure 5:
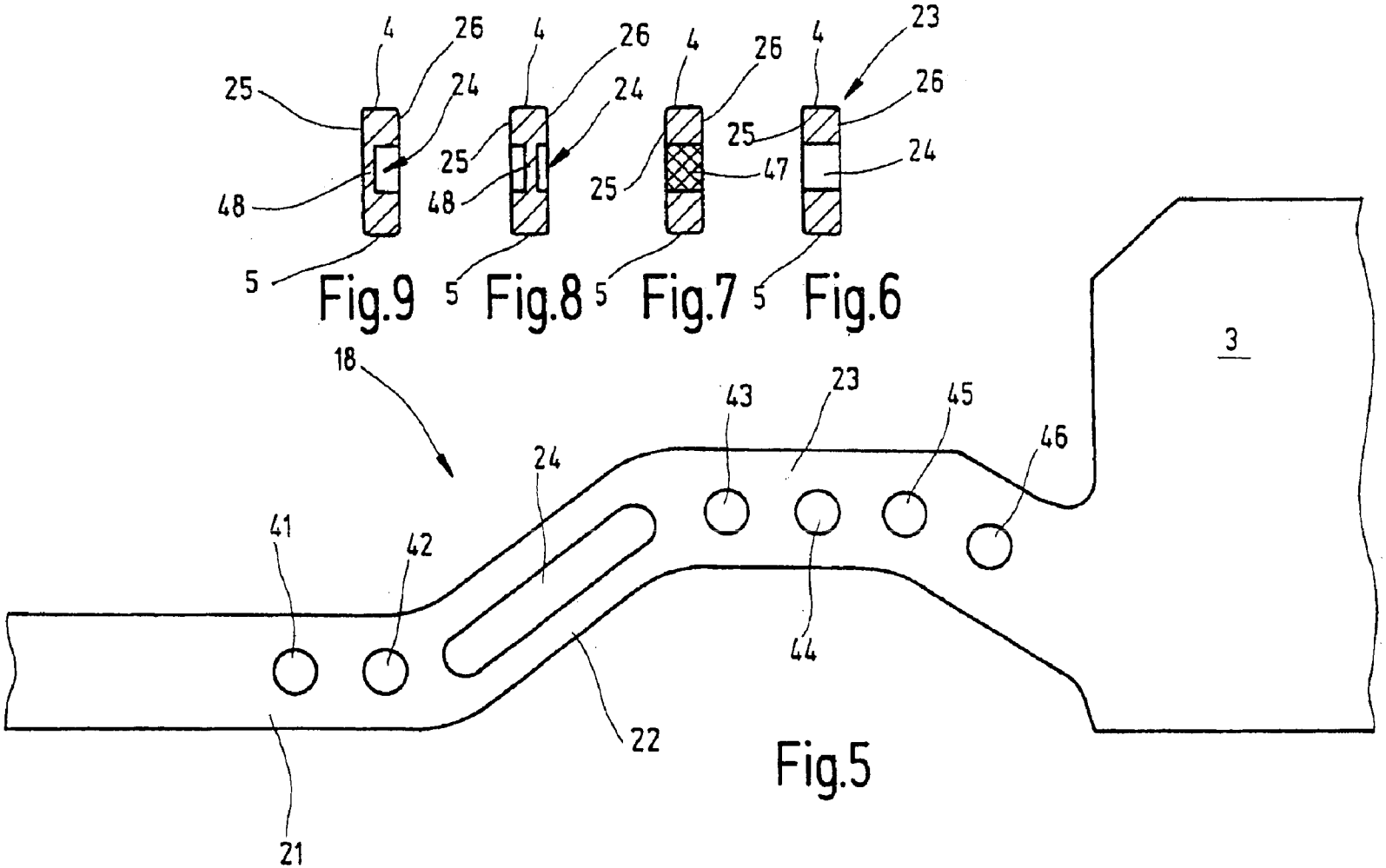

Another modified embodiment is illustrated by FIG. 5. Here the portion 22 forms an obtuse angle with each of the adjacent portions 21, 23. The recess 24 is disposed predominantly, preferably in the form of a straight slot, in the portion 22. It may also extend with curved ends into the portions 21, 23. In these portions, still further recesses 41, 42, 43, 44, 45, 46 are embodied, for instance in the form of circular openings, and their diameter approximately matches the slot width of the recess 24. This knitting machine needle likewise has improved resilience in the region of its deflection 18 and has a lesser tendency to hard breakage than comparable knitting machine needles that lack recesses embodied in the region of the deflection 18.

All the recesses of the knitting machine needles described above may be open, as shown in FIG. 6. However, it is also possible for them to be provided with a complete or partial filling 47 of damping material, as shown in FIG. 7. This filling may be a plastic, a natural substance, elastomer, rubber, or a metal that differs from the metal from which the rest of the knitting machine needle is embodied. It may for instance have a different internal damping, mass, strength, and so forth.

The damping material contributes to the absorption of impact energy that can be introduced into the knitting machine needle 1 at the butt 3. In particular, it prevents the transmission of the impact energy to the hook 16.

The recesses 24, 37, 38 as well as the recesses 41, 42, 43, 44, 45, 46 may also be embodied as a noncontinuous recess, as shown in FIG. 8 or FIG. 9. This is shown in FIGS. 8 and 9 taking the recess 24 as an example, which there has a bottom 48. The bottom 48 further contributes to the stiffening. It makes it possible to leave especially narrow stems 31, 32 to both sides of the recess 24 without thereby overly weakening the knitting machine needle in terms of its stability. A damping material that fills the applicable recess 24 may be disposed on the bottom 48, similarly to what is shown in FIG. 7.

A knitting machine needle 1, having a butt 3 pointing away from its needle body 2 and a shank 15 extending from the needle body as far as a hook 16, has a deflection 18 which is disposed between the hook 16 and the butt 3. The deflection 18 is provided with at least one recess 24, which locally alters the wave resistance of the deflection 18 and leads to a reduction in hook breakage when the butt 3 is exposed to impacts.

| List of Reference Numerals: | |
|---|---|
| 1 | Knitting machine needle |
| 2 | Needle body |
| 3 | Butt |
| 4 | Face |
| 5 | Needle back |
| 6, 7, 8, 9 | Recesses |
| 11, 12, 13, 14 | Stems |
| 15 | Shank |
| 16 | Hook |
| 17 | Latch |
| 18 | Deflection/meander |
| 21, 22, 23 | Portions |
| 24 | Recess |
| 25, 26 | Flat sides |
| 27, 28 | Openings |
| 31, 32 | Stems |
| 33 | Needle family |
| 34, 35, 36 | Knitting machine needles |
| 37, 38 | Recesses |
| 41, 42, 43, 44, 45, 46 | Openings |
| 47 | Damping material |
| 48 | Bottom |
| H | Height |
| R | Radius |
| NH | Needle body height |

What is claimed is:

1. A knitting machine needle having a needle body which has at least one butt and one hook and which between the hook and the butt has at least one meandering curve portion, with the at least one meandering curve portion being formed by a first portion extending in a longitudinal direction of the body, a second portion extending transversely to the first portion, and a third portion transversely spaced from the first portion and again extending in the longitudinal direction of the body, with the second portion being disposed between the first portion and the third portion: and said meandering curve portion is provided with at least one recess that follows the curve of the meandering curve portion and extends along a lenght of the second portion and at least a part of a length of each of the first and third portions.

2. The knitting machine needle of claim 1, wherein the second portion disposed between the first portion and the third portion essentially forms a right angle with each of the first and third portions.

3. The knitting machine needle of claim 1, wherein the first portion, second portion, and third portion all have the same height (H).

4. The knitting machine needle of claim 1, wherein the height (H) of the first portion, of the second portion, and of the third portion is less than ⅓ of the needle body height (NH).

5. The knitting machine needle of claim 1, wherein the recess is a continuous recess that extends along the entire meandering curve portion.

6. The knitting machine needle of claim 1, wherein the recess is embodied as a slot.

7. The knitting machine needle of claim 6, wherein the slot, in the region of the meandering curve portion, has rounded corners whose radius R is greater than the width of the slot.

8. The knitting machine needle of claim 1, wherein a plurality of recesses are provided in the region of the meandering curve potion.

9. The knitting machine needle of claim 1, wherein in addition to the butt, at least one further butt is provided.

10. A needle set having knitting machine needles and at least one knitting needle of claim 1, wherein the knitting needles have their respective butts at different points.

11. The knitting machine needle of claim 4, wherein the respective height (H) of each of the first portion, the second portion, and the third portion is less than ⅕ of the needle body height (NH).

12. The knitting machine needle of claim 2, wherein the recess is a slot that, in the region of the meandering curve portion, has rounded corners whose radius R is greater than the width of the slot.

13. The knitting machine needle of claim 6, wherein the slot extends completely through the first, second and third portions of the meandering curve portion.

14. The knitting machine needle of claim 13, wherein the recess is a continuous slot that extends along the entire meandering curve portion, and is provided with a respective circular opening at each of its ends.

15. The knitting machine needle of claim 1, wherein the at least one recess includes a slot disposed along a longitudinal axis of the second portion and a respective further slot extending along a longitudinal axis of each of said first and third portions.

16. The knitting machine needle of claim 1, wherein the at least one recess includes a slot disposed along a longitudinal axis of the second portion and a respective plurality of circular openings extending along a longitudinal axis of each of the first and third portions.

17. A flat elongated knitting machine needle comprising: a needle body having a front end, a back and a top face with a height corresponding to a distance between the top face and the back, a butt extending transversely from the top face, a recess extending from the back into the body and forming a stem, of a height less than the height of the body, extending longitudinally along the top face of the body between the butt and the front end, and an adjoining transversely extending body portion at the front end; a shank, having a hook at one end and a height less than that of the body, adjoined to and extending longitudinally from the transversely extending body portion and being transversely displaced from the stem; and at least one recess that extends along a longitudinal axis of each of the transversely extending body portion and adjoining portions of each of the stem and the shank.

18. The flat elongated knitting machine needle of claim 17 wherein the recess is continuous.

19. The flat elongated knitting machine needle of claim 17 wherein the transversely extending body portion and the portions of the shank and stem all have the same height.

20. The flat elongated knitting machine needle of claim 17 wherein the transversely extending body portion forms substantially a right angle with each of the stem and the shank.

* * * * *